US006456785B1

(12) United States Patent
Evans

(10) Patent No.: US 6,456,785 B1
(45) Date of Patent: Sep. 24, 2002

(54) RESISTANCE HEATING ELEMENT

(76) Inventor: Robert Evans, 36 Elm St. Butternut Dr., North Grafton, MA (US) 01536

( * ) Notice: Subject to any disclaimer, the term of this patent is extended or adjusted under 35 U.S.C. 154(b) by 0 days.

(21) Appl. No.: 09/616,525

(22) Filed: Jul. 14, 2000

Related U.S. Application Data

(63) Continuation-in-part of application No. 09/323,257, filed on Jun. 1, 1999, now abandoned.

(51) Int. Cl.[7] ..... F24H 1/10
(52) U.S. Cl. ..... 392/488; 392/448
(58) Field of Search ..... 392/488, 489, 392/485, 448; 338/296, 298, 299, 329, 330, 62, 63, 322; 219/544, 541, 552, 530, 540

(56) References Cited

U.S. PATENT DOCUMENTS 1,869,140 A * 7/1932 Gelinas ..... 338/238
2,727,979 A * 12/1955 Altosaar ..... 392/448
3,199,058 A * 8/1965 Cramer et al. ..... 338/237

* cited by examiner

*Primary Examiner*—Philip H. Leung
*Assistant Examiner*—Vinod D Patel
(74) *Attorney, Agent, or Firm*—Lambert & Associates; Gary E. Lambert; Edward Timmer

(57) ABSTRACT

A system for electrically heating a flow of liquid singularly passing over a heating element contained within a housing. Liquid is inserted into the housing and passes over a heating element, with the straight embedded resistance wire, which causes the liquid to be heated faster and with less energy than would be employed by a coiled heating element. The heating element is composed of resistance wire connected to a conductor lead by a transition splice, all surrounded by compacted magnesium oxide encased within a stainless steel sheath.

14 Claims, 7 Drawing Sheets

ASSEMBLED CUT AWAY

END CAP (END CAP FOR STRAIGHT LINE CONFIGURATION)

RESISTANCE HEATING ELEMENT

CROSS REFERENCE TO RELATED APPLICATIONS

This application claims the benefit in the form of a continuation-in-part under 37 CFR 1.53(b)(1) of currently pending parent application, Ser. No. 09/323,257 filed Jun. 1, 1999, now abandoned by the same inventor.

FIELD OF THE INVENTION

This invention relates generally to the heating of fluid media and materials by utilizing a resistance heating element.

BACKGROUND OF THE INVENTION

For several decades, apparatuses for heating air and materials have been designed to perform in a highly efficient manner. Such designs entail consecutively wound offset spirals of resistance wire encased in a tube or flow-chamber wherein each previously wound spiral acts as a pre-heater for each of the following spirals. In most cases, this electrically charged wire is insulated by some exterior tube of refractory (hi temp) material such as ceramic or the like. These heaters work by forcing a gas, normally air, into one end of the heater and causing it to pass through a ceramic tube which supports the resistance wire and, as the air is passed over the resistance wire, it picks up energy as it transverses its way through the maze of offset spirals. This design is by far one of the most efficient and accurate methods of controlling the heating of air or gas by the use of electrical power. The drawback to this design, however, is that it provides for a very poor way to heat water or other liquids, as the electrically charged circuit is in direct contact with the media flowing over it. In most cases, liquids are not adequate candidates for such heating systems, i.e. a hair dryer in a bath tub.

Other manners of employing resistance elements for heating include heating solid materials such as metals, which possess strong temperature conductive characteristics, by way of direct contact with the solid metals. An example of such usage would be employing a resistance heater to heat metal dies.

Prior to the instant invention, contact heaters of choice for liquids, volatile gases and metals are usually those encased in some form of metal. Of course, the metals that these heaters are encased in do not perform the active heating. Rather, such metals merely act as the exchange/transfer media. A more common example of such a heating mechanism is best exemplified by the standard electric stove in a home. Within such a stove, heating on the "range" is accomplished by the so-called black, circular-wound coils, which are commonly referred to in the industrial community as tubular heaters. Tubular heaters are actually made of three different materials. The first and most important material is the resistance coil in the core of the "tube." The next material surrounding the resistance coil is the electrical insulation, which ensures that none of the electrical energy escapes and finds an easier route for performing its intended function, which is to produce heat. This electrical insulation also performs the additional function of transferring the heat from the resistance coil to the third and final material, the encompassing steel casing. This steel casing, which is a tube itself, provides structural stability and a reasonable means of heat dissipation. By virtue of this design, this form of "heater" is perfect for heating liquids because the electricity passing over the resistance coil is shielded by the layer of electrical insulation. In turn, the insulation transfers its energy to the steel casing which transfers it's energy to the process of heating a substance. An excellent example of a tubular heater of the prior art is the IHCO PYROROD Tubular Heater disclosed in the Information Disclosure Statement submitted herewith. In view of this reference, the construction differences between the prior art and the instant invention are clearly shown.

Heretofore known products used in liquid heating and contact heating applications use tremendous electrical power and are slow and seemingly inefficient. Prior to the instant invention, in order for one to obtain a significant change in temperature in a moving liquid using a single-pass (vs. circulating) system, one was required to apply a large amount of electrical power to a system that required a significant amount of space in order to function properly.

The same problems apply to heating static, conductive materials with prior art resistance heaters. The coiled resistance wire in effect heats itself as it imparts energy to the heated material causing it to operate a higher temperature. Thus, too high a percentage of the energy generated by the coil dissipates into the surroundings, and the heater becomes extremely inefficient.

The end result of employing such an apparatus for either of the above applications was that it was bulky, inefficient, and not practical for most applications since it required too many amps.

The prior art discloses several attempts to circumvent the above-stated shortcomings. The most common of these prior art devices and methods for use in industrial application are the cartridge (depicted in the IHCO PYROWATT cartridge immersion heater), circulation (depicted in the informational brochure "Introduction to Circulation Heaters") and immersion type heaters (depicted in the IHCO PYROROD tubular immersion heater), shown and described in applicant's Information Disclosure Statement submitted herewith. Other attempts at single pass heaters are best identified by their tradenames and marks and are known by the names of EEmax, Thermotronic, Arriston, Power Stream, SET's and Keltech/Accutemp, all shown in more detail in the applicant's Information Disclosure Statement.

The common deficiencies encountered with the said named products are that their efficiency ratings and durability are not as high as a wound, tubular design, as often found with air heaters. The primary shortcoming of all of these products is that they require an enormous amount of electrical service in order to make each one of these devices practically useful. Another important shortcoming of the prior art systems centers on the bulky configuration of the heating element structure.

SUMMARY OF THE INVENTION

In the above discussed prior art references, a procedure of wrapping the resistance wire into a coil was utilized to compensate for the mechanical stretching of the resistance wire inherent in the splicing or swaging process used to make the transition between conductor leads and resistance wire occurs. Other applications included a wire coil which is threaded or welded over a conductor lead or splicing mechanism. Along with creating a very bulky heating element, this coiling of the resistance wire causes great energy loss due to bunching of the wire in the swaging process. To compensate for the above-mentioned mechanical stretching, the transitional splice employed in the instant invention consists of a slide splice to join the resistance wire and conductor leads in the swaging process.

The slide splice allows for splicing a first wire possessing a first end and a second end to a second wire possessing a first end and second end. The wire splice retains the first end of the first wire and the first end of the second wire and allows axial movement of at least one the wires during the splicing process, while still maintaining the integrity of the splice and allowing current to flow.

A slide splice can simply be constructed of high-grade hypodermic nickel tubing, to a controlled depth, depending on the finished length of the heater. The motion of the wire inside the heater is compensated by the action of the slide splice. In addition to decreasing the overall outside diameter of the heater and extending the overall length of the heater, the useful function of this slide splice design is that it allows a conductor/resistance wire junction to be maintained after the physical elongation of the heater during and after the swaging process.

Before the swaging process, the end of the resistance wire is butted up against the end of the conductor lead as both are placed inside the slide splice. During the swaging process, the resistance wire tends to move axially away from the conductor lead. Due to this action, a void between the resistance wire end and conductor lead end is formed inside the slide splice. In many applications, this void would be fatal to the integrity of the resistance circuit. However, the properties inherent to the slide splice allow for the unavoidable axial motion and subsequent void development and thus allow for heater expansion, since the lengthening of the resistance wire creates a larger surface area for the heating element. This process increases the heated length of the element just as the customary coiled resistance wire does except that utilization of the slide splice allows a straight element resistance circuit to be held. Thus the slide splice provides a quick way of affixing the joint and allows room for the expansion of the wire inside the splice while still maintaining the integrity of the splice.

The instant invention therefore disposes of the above mentioned shortcomings of conventional heating elements by eliminating the need for forming the resistance wire into a coil. By compensating for elongation with the slide splice, the new invention inherently creates a more compact heating element in the process. Once the need to coil the resistance wire no longer exists, the inherent energy loss due to the wire bunching on the coil disappears. The energy supplied to the heating element can be transferred directly to the fluid or material to be heated, without having to overcome "hot spots" that are commonly encountered when wire bunching occurs. Thus, less electrical service is required to operate the instant system efficiently.

In much the same manner as the straight line heating element, the oval shaped heating coil eliminates "hot spots" created by wire bunching. Due to the longer straight wire runs on the oval shaped element, as compared with the prior art circular configurations, there exists less chance for wire bunching.

The instant invention also provides for extremely uniform and concentric heat generation as compared to the prior art coiled heaters. In a customary tubular heater, the coil has a tendency to work against itself, in that the opposite end of the exact same coil will be heating the same area of the overall heater. The superior structure of the instant invention, including a straight line heating element, disposes of this problem.

The same holds true for the oval shaped heating element as configured with the flow diverter. The longer straight runs of the oval shaped element, as compared with prior art circular heaters, working in conjunction with the fluid guiding properties of the flow diverter, allow for a more laminar flow throughout the heater and also serve to redirect fluid that would be trapped in the inner coil areas. Therefore, the coils do not get to reheat or overheat the fluids, and the areas where prior art coils tend to work against themselves are negated.

When configured to heat solid materials, the element channels much of the heat from the resistance wire that would normally work against itself to the solid much more efficiently than in standard prior art coiled resistance wire heaters. This allows for much less energy loss and thus a greater efficiency level than prior art coiled heating elements.

When utilized to heat liquids, the instant invention allows for less liquid back up and turbulent flow at the inlet of the heater than prior art heaters. The instant design inherently "chokes back" less liquid to the inlet walls and heating element entry area. This feature allows for a more laminar flow of liquid upon entry into the heater and thus ensures more even heat transfer and no significant energy pick up by the liquid at the inlet.

Finally, when engaged to heat solid materials, such as metal dies or plates, the instant invention offers faster more direct contact with the surface to be heated than prior art resistance heaters. The faster more direct the heat transfer, the less energy must be supplied in order to operate the system. Therefore, the instant invention provides a more cost effective alternative to heating metals.

These embodiments represent only a few of the modes in which the instant invention may be deployed and are in no way meant to restrict use the heating element to these applications. Other embodiments of the invention may be used without departing from the scope of the present invention as set forth in the appended claims.

The present invention has as its primary object the provision of an improved heating apparatus and system for heating fluid media and solid materials as well.

A more particular object of the present invention is the provision of a single-pass water heating apparatus and system having improved operational characteristics over the apparatuses and systems heretofore known and having the above noted disadvantages.

A further object of the present invention is the implementation of a more efficient system to heat solid materials, such as metal dies, which reduces heat dissipation away from the solid material and also reduces the amount of energy necessary to operate the system within the necessary parameters.

A further object of this invention is the creation of a more rugged or durable apparatus or system, which inherently possesses improved electrical efficiencies, all contained within a more compact design than that previously known or used.

Although the above features can be looked on as preferred manners of utilizing the invention, these suggestions are not meant to limit the fashion in which the instant invention may be configured or utilized. Other and further objects of the invention will be apparent from the following description and claims and may be understood by reference to the accompanying drawings, which by way of illustration, show preferred embodiments of the invention and what is now considered to be the best mode in applying principles of the invention.

DETAILED DESCRIPTION OF THE PREFERRED EMBODIMENTS

Figure 1:
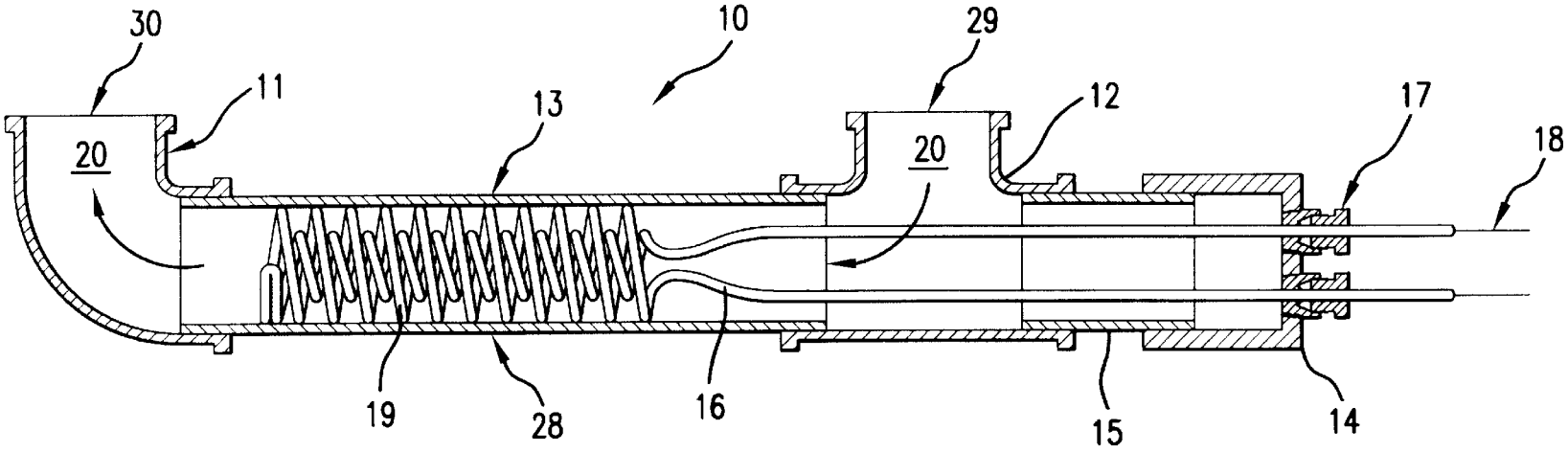
FIG. 1 is a cross-sectional view of the single-pass liquid heating system with the heating element and flow diverter shown together with electrical connections for operating the heating system.

Referring now to FIG. 1, a one application for the resistance heating element, a single-pass liquid heating system is shown generally at 10. The housing 28 portion of system 10 is constructed of a pipe elbow 11 attached to a pipe tee 12 by a six inch pipe nipple 13 and a pipe cap 14 attached to tee 12 by a pipe close nipple 15.

In one configuration, the heating element 16 is a tubular heater that is wound, in a circular or oval shape within the area covered by pipe nipple 13, in a series of successive offsets. A flow diverter 19 is contained within the inside confines of these offsets. Heating element 16 is held fast by the use of compression fittings 17, threaded into pipe cap 14, over the straight lengths of heating element 16. Conductor leads 18 of heating element 16 are provided on the cold end or input side of heating element 16.

Figure 2:
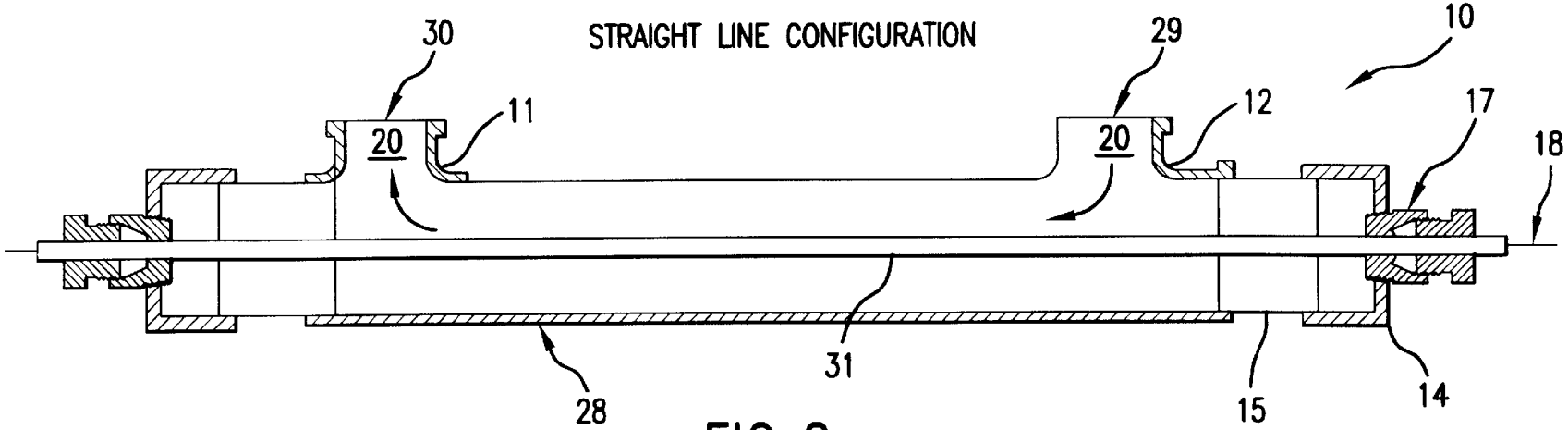
FIG. 2 is a cross-sectional view of the single-pass liquid heating system with the straight line heating element with electrical connections for operating the heating system.

In another configuration, (FIG. 2), the heating element 16 is of a straight line construction that is also maintained within the area covered by pipe nipple 13. Heating element 16 is held fast by the use of compression fittings 17, threaded into pipe cap 14, over the straight lengths of heating element 16. Conductor leads 18 of heating element 16 are provided on the cold end or input side of heating element 16.

The system is operated by applying an electrical current to conductor leads 18 that, in turn, causes heat to emanate from heating element 16 or 31. The liquid substance to be heated is then forced into pipe tee 12 and caused to travel through thermal transfer flow channel 20 on its way to pipe elbow 11. Either the straight line 31 or oval coiled 16 configuration, within nipple 13, provides for and creates a clean path for the liquid moving through flow channel 20. Furthermore, this arrangement and movement of liquid ensures that no significant energy is picked up by the liquid near tee 12 and is constantly exchanged with new liquid entering tee 12 as the heating element 16 operates. As the liquid moves through flow channel 20, the straight line heating element 16, by providing less restrictions to flow increases the rate of the liquid velocity, creating a more thermally homogenous product, and aiding in the lower temperature operation of the heating element 16.

Figure 3:
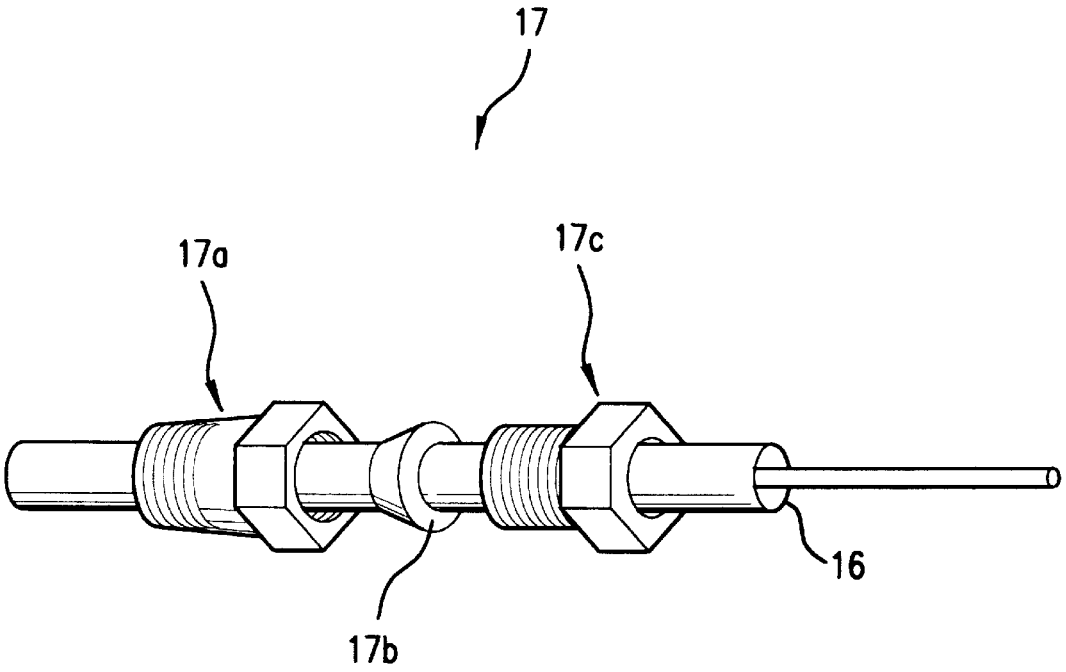
FIG. 3 is an exploded view of compression fitting head, ferrule and compression fitting body.
Figure 3A:
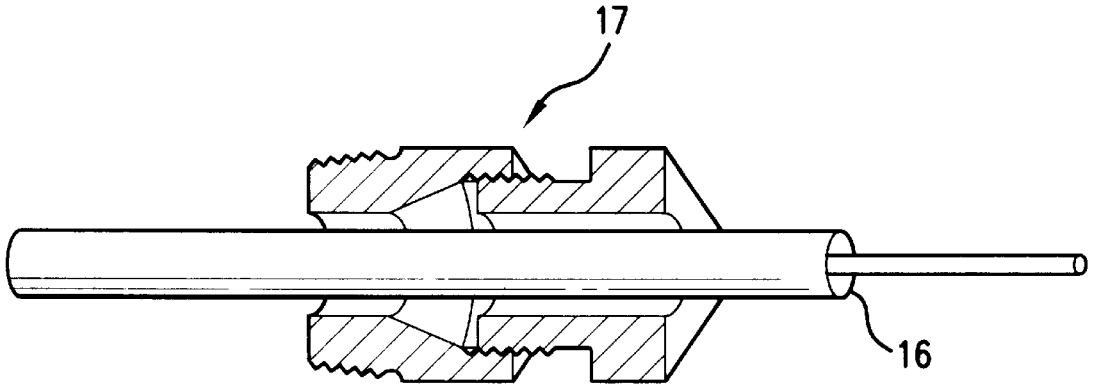
FIG. 3A is an assembled, cut-away view of the compression fitting head, ferrule and compression fitting body of FIG. 2.

FIG. 3 more clearly defines the compression fittings 17 that hold heating element 16 within the confines of system 10. Fittings 17 are comprised of a compression fitting body 17*a,* to which a ferrule 17*b* is inserted within the inside wall of body 17*a,* joined to a compression fitting head 17*c*. The compression of ferrule 17*b* against the inside wall of body 17*a* mechanically seals the straight length of heating element 16 so as to provide a high pressure, hermetic seal for the interior portion of heating system 10, as shown in FIG. 3A.

Figure 4:
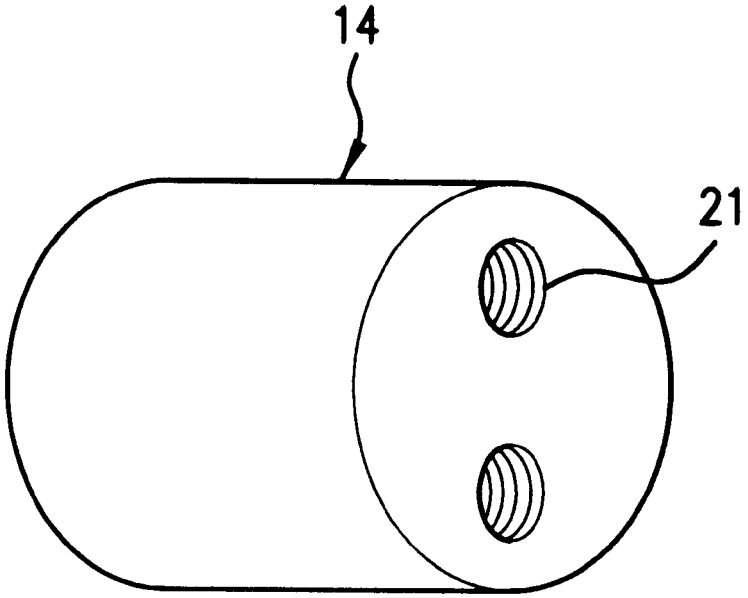
FIG. 4 is a perspective view of the machined threaded pipe cap for the coiled heating element variation.

Referring now to FIG. 4, threaded pipe cap 14 is shown with drill/tap holes 21. Compression fitting bodies 17*a* are threaded within holes 21 to seal system 10.

Figure 4A:
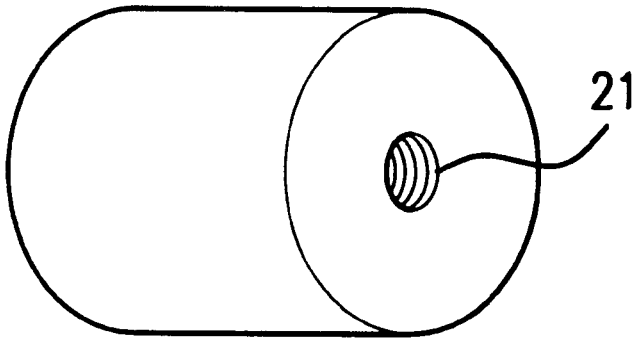
FIG. 4A is a perspective view of the machined threaded pipe cap for the straight line heating element variation.

FIG. 4A. shows the end cap configuration for the straight line heating element variation with only one hole 21 in the cap.

Figure 5:
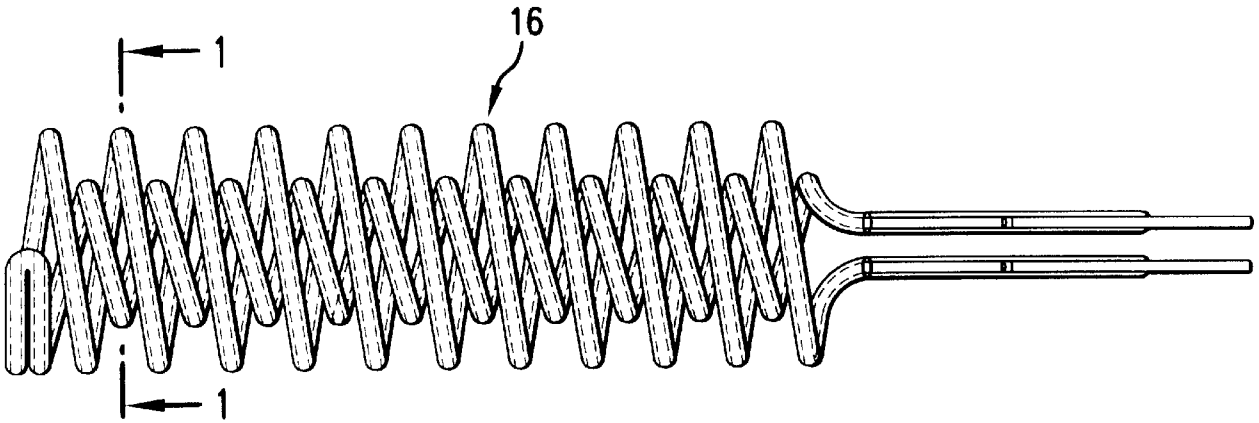
FIG. 5 is an elevational view of the coiled heating element with the spliced portion thereof shown in cross-section.
Figure 6:
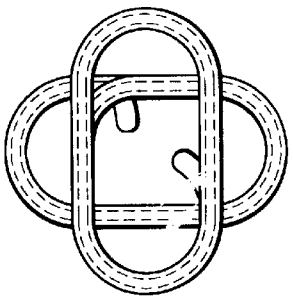
FIG. 6 is a side view of the coiled heating element as would be seen from plane I—I of FIG. 5.

FIG. 5 depicts coiled heating element 16 separated from system 10. As shown in FIG. 6, heating element 16 is comprised of oval offsets, wound in successive fashion, to provide the maximum heating surface contact for liquid passing through channel 20.

Figure 7:
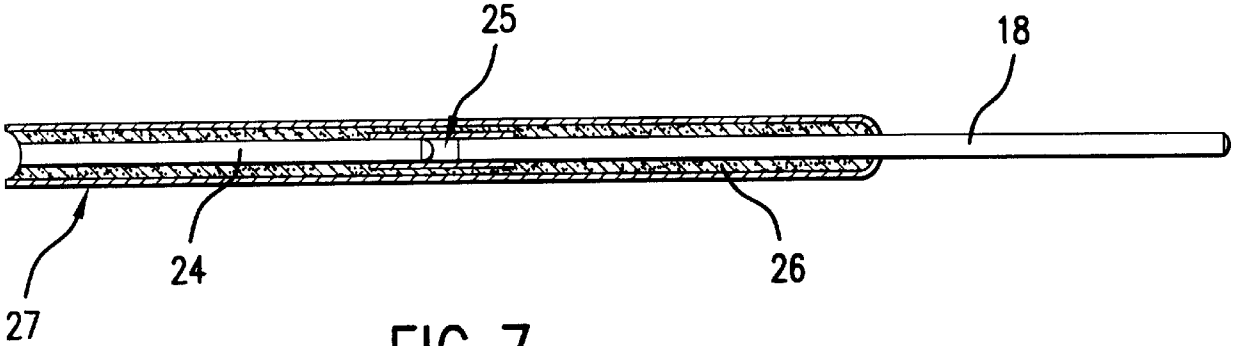
FIG. 7 is an enlarged view of the cross sectional view of the coiled heating element shown in FIG. 5.

Referring now to FIG. 7, an enlarged view of the cross sectional view of the coiled heating element shown in FIG. 5, the various components of the coiled heating element 16 are depicted. The conductor lead 18 is shown joined to resistance wire 24 by transition splice 25. Compacted magnesium oxide 26 surrounds conductor lead 18, wire 24 and splice 25 and is tightly held in place by stainless steel sheath 27.

Figure 8:
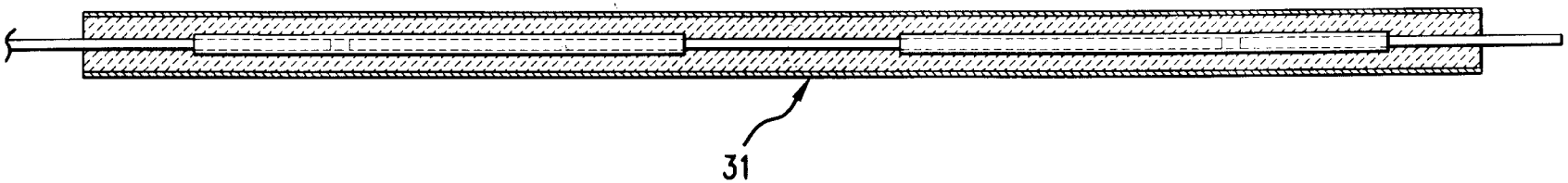
FIG. 8 is an elevational view of the coiled heating element with the spliced portion thereof shown in cross-section.

FIG. 8 depicts the straight line heating element 31 separated from system 10. As shown in FIG. 4, heating element 16 is comprised of straight line structure, to provide the maximum laminar flow while also allowing for extremely uniform and concentric heat generation for liquid passing through channel 20.

Figure 9A:
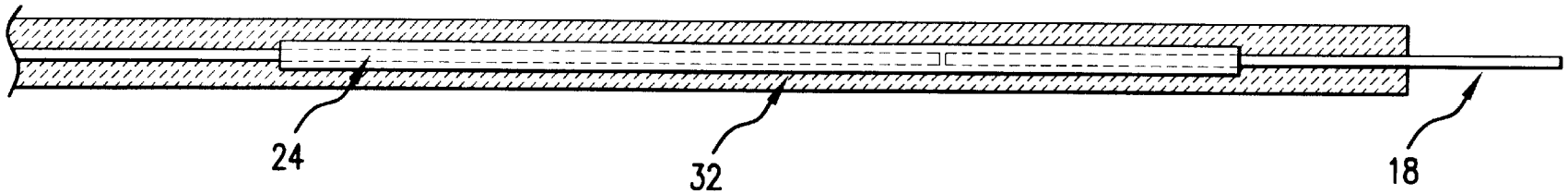
FIG. 9A is an enlarged view of the cross sectional view of the straight line element shown in FIG. 8, as the splice area appears before the swaging process.

In FIG. 9A, an enlarged view of the spliced portion of the coiled heating element shown in cross-sectoin in FIG. 8, the slide splice for the straight line heating element 31, before the swage process, is depicted. The conductor lead 18 is shown joined to resistance wire 24 by transition slide splice 32. Compacted magnesium oxide 26 surrounds conductor lead 18, wire 24, and slide splice 32 and is tightly held in place by stainless steel sheath 27. Note the proximity of the ends of the resistance wire 24 and the conductor lead 18 inside the slide splice 32 before the swaging process. The ends are set in the slide splice to butt against each other before the swaging process. During the process, the resistance wire 24 is pulled away from the conductor lead 18.

Figure 9B:
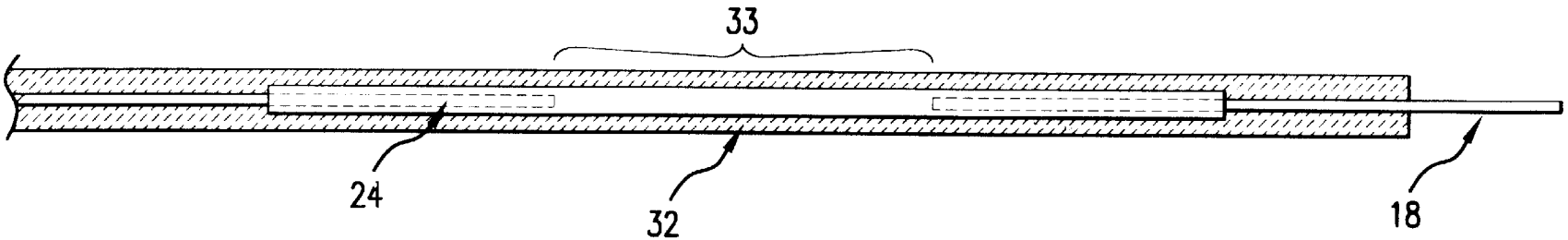
FIG. 9B is an enlarged view of the cross sectional view of the straight line element shown in FIG. 8, as the splice area appears after the swaging process.

FIG. 9B illustrates the motion of the resistance wire during the swaging process. Note the void 33 created, due to the resistance wire 24 motion, inside the slide splice 32 between the ends of the resistance wire 24 and conductor lead 18.

Figure 10:
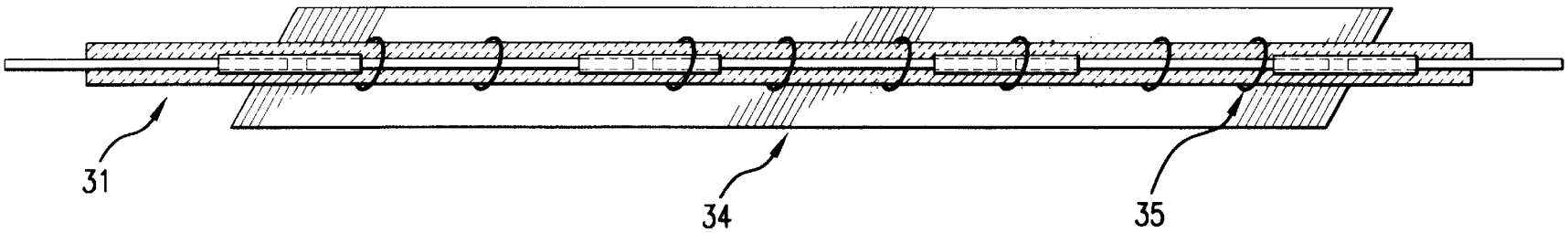
FIG. 10 is an elevational view of the straight line resistance heating element 31 as employed to heat a metal plate.

FIG. 10 illustrates the straight line resistance heating element 31 as employed to heat a plate of metal 34. The heating element is attached directly to the plate by a fastening means or welding in order to make direct contact and thus maximize heat transfer.

When employed in a fluid heating system, the system performs accordingly when an electrical current is applied to conductor leads 18 and a fluid, preferably water, is forced into the inlet 29 of tee 12, caused to flow through channel 20, around heating element 16 or 31, and out of outlet 30 of elbow 11. The configuration of heating element 16, within nipple 13, along with the placement of flow diverter 19, used in combination with the oval coiled heating element provides for and creates an obtrusive path for the liquid moving through flow channel 20. Furthermore, this arrangement and movement of liquid ensures that no significant energy is picked up by the liquid near tee 12 and is constantly exchanged with new liquid entering tee 12 as the heating element 16 operates.

As the liquid moves through flow channel 20, it continually encounters the successive oval wound offsets of heating element 16. The offset design forces the flow of liquid to shift in direction after every ascending offset oval, gaining higher surface contact with the liquid and with turbulent flow assisting in temperature uniformity. When used in combination with the flow diverter, the liquid achieves maximum heat transfer along with retaining the overall laminar flow. This interaction allows the element to operate at a lower temperature, and accomplish the same end result, than would be required in the absence of such configuration.

In the coiled heating element construction, flow diverter 19 assists in localizing the cross-sectional flow region in the thermal transfer flow channel 20. By occupying the central area of the heating element 16, flow diverter 19 causes the liquid to be redirected over the oval offsets, increasing the rate of the liquid velocity, creating a more thermally homogenous product, and aiding in the lower temperature operation of the heating element 16.

When utilized the straight line element 31 in fluid heating system, the fluid flows in a laminar manner across the smooth element, thus providing extremely uniform and concentric heat generation and reducing any turbulent flow or overheating experienced in conventional systems.

Employing the straight line configuration to heat metals, the element can be imbedded in the metal if there is large interior area to be heated, such as in metal dies. The straight line element 31 can also be attached to the surface of a flat plate of metal 34 by fasteners 35 or welded to the surface of the plate as illustrated in FIG. 10.

Heating element 16 or heating element 31 are manufactured by cutting an 0.1880" outside diameter stainless steel sheath 27 to the length of 64". No. 19 American Wire Gauge (AWG) Nickel Chrome resistance wire 24 is cut to the length of 54". Transition splices 25, with an outside diameter of 0.0613" and inside diameter of 0.0520", are cut from Nickel 200 tubing to form two lengths of 6" each. Two 6" pieces of 18 AWG Nickel wire are cut to form the conductor leads 18.

Both ends of resistance wire 24 are inserted into transition splices 25 to a depth of 4.5000". Metal oxide cores, preferably Magnesium Oxide (MgO) Cores (magnesium oxide extruded under high pressure, usually in 1"–2" lengths tubes, green in state), with a 0.0850" inside diameter and 0.1250" outside diameter, 1.2500" long, are then slid end to end over the entire length of resistance wire 24, splice 25 and conductor lead 18. The entire length of resistance wire 24, splice 25 and conductor lead 18 is inserted, with MgO cores, into sheath 27, (until swaged, the preceding components will be referred to as the assembly) allowing a 1" portion of conductor lead 18 to protrude out of either end of sheath 27. Tape is wrapped over the conductor lead 18 and overlaps onto the end of sheath 27. The assembly is stood upright, with taped end down, and affixed to the supports of a vibration machine.

A vibration machine is a machine used in the tubular heating element 16 manufacture to help completely fill and carry the MgO granules throughout the entire length of a heating element by using high frequency vibration. Using a funnel on the top end of the assembly, opposite the taped end, MgO granules (magnesium oxide in a loose form, beige in color, and consistency resembling granulated sugar, used in tubular heating element 16 manufacture to fill in voids between MgO cores, and spaces between cores and sheath 27), 200 grit, are poured into sheath 27 until funnel is full. The Vibration machine is then turned on and allowed to vibrate for no less than four hours. The Vibration machine is then turned off and funnel and assembly are removed from the vibration machine. The assembly is then attached to a swaging machine (a machine used to reduce the diameter of tubing or rod stock and which causes the hardening of material and elongation) and the end of the assembly is swaged without tape. After 24" of the assembly is swaged the assembly is removed from the swaging machine. The tape is removed from sheath 27 and conductor lead 18 and the portion comprising this end is swaged (a technique used in the tubular heating industry to pack the MgO cores and MgO granules to a homogeneous compound which yields the effects of a higher heat transfer efficiency, longer element than starting length, and smaller diameter than starting diameter) until the full length of the assembly has been sent through the swaging machine. Once swaged, the assembly will be referred to as heating element 16.

The outside portion of system 10 is manufactured as follows. A 1¼" National Pipe Thread (NPT) 6" long nipple 13 is threaded into 1¼" NPT elbow 11. The straight section of the 1¼" NPT Tee 12 is threaded onto nipple 13 on the opposite end of the elbow 11. A 1¼" NPT close nipple 15 is threaded onto the opposite straight end of tee 12, leaving the 90 degree, single opening of the tee 12 unoccupied. For the coiled heating element structure, two ⅜" diameter holes are drilled into the outside flat surface of a 1¼" pipe cap 14, the holes to be ⅜" off centerlines, ¾" center to center hole spacing. Two holes are tapped in pipe cap using a ⅛" NPT tap. Two ⅛" NPT compression fitting bodies 17*a* are screwed into drilled and tapped holes in pipe cap 14. Two straight ends of heating element 16 are slid through the center of each compression fitting body 17*a*. Ferrules 17*b* are slid over the ends of heating element 16 and positioned inside the compression fitting bodies 17*a*. Heating element 16 is positioned so that ½" protrudes beyond the female end of the compression fitting bodies 17*a*. Compression fitting heads are positioned over the heating element 16 ends and screwed into the female end of the compression fitting bodies 17*a*, securing the ferrules 17*b* between body 17*a* and head 17*b*, and tighten uniformly. The 1¼" NPT pipe cap 14 is threaded with heating element 16 and compression fittings 17 attached to the 1¼" NPT close nipple 15.

For the straight line heating element variation, one ⅜" diameter hole is drilled into the outside flat surface of the two 1¼" pipe caps 14, the holes to be ⅜" off centerlines, ¾" center to center hole. One hole is tapped in pipe caps at either end of the system using a ⅛" NPT tap. One ⅛" NPT compression fitting bodies 17*a* are screwed into drilled and tapped holes in pipe caps 14. Two straight ends of heating element 16 are slid through the center of each compression fitting body 17*a*. Ferrules 17*b* are slid over the ends of heating element 16 and positioned inside the compression fitting bodies 17*a*. Heating element 16 is positioned so that ½" protrudes beyond the female end of the compression fitting bodies 17*a*. Compression fitting heads are positioned over the heating element 16 ends and screwed into the female end of the compression fitting bodies 17*a,* securing the ferrules 17*b* between body 17*a* and head 17*b,* and tighten uniformly. The 1¼" NPT pipe cap 14 is threaded with heating element 16 and compression fittings 17 attached to the 1¼" NPT close nipple 15.

I claim:

1. A heating element, comprising:

a resistance wire having a first and second end;

a first and second conductor lead, said first and second conductor lead having a first and second end, said first end of said first conductor lead joined to said first end of said resistance wire by a first transitional splice and said first end of said second conductor lead joined to said second end of said resistance wire by a second transitional splice; a compacted metal oxide completely surrounding and covering the entire length of said resistance wire and a portion of said conductor leads; and a stainless steel sheath covering and enclosing said compacted metal oxide against said resistance wire and said first and second conductor leads; wherein a portion of said heating element is wound in ascending oval offsets; and wherein a flow diverter is set inside said oval offsets.

2. The heating element of claim 1 wherein said compacted metal oxide is magnesium oxide.

3. The heating element of claim 1 wherein said heating element is utilized to heat solid materials.

4. The heating element of claim 3 wherein said heating element is utilized to heat solid metals.

5. The heating element of claim 1 wherein said heating element is utilized to heat fluids.

6. The heating element of claim 5 wherein said heating element is utilized to heat fluids in a single pass fluid heating system.

7. A heating element, comprising:

a resistance wire having a first and second end;

a first and second conductor lead, said first and second conductor leads each having a first and a second end, wherein said first end of said first conductor lead is joined to said first end of said resistance wire by a first transitional splice and said first end of said second conductor lead joined to said second end of said resistance wire by a second transitional splice; compacted metal oxide completely surrounding and covering the entire length of said resistance wire and a portion of said first and said second conductor leads; and a stainless steel sheath covering and enclosing said compacted metal oxide against said resistance wire and said portion of said conductor leads to form an assembly; said assembly swaged together; and wherein said assembly retains a straight line configuration.

8. The heating element of claim 7 wherein said metal oxide completely surrounding and covering the entire length of said resistance wire and said portion of said conductor lead is magnesium oxide.

9. The heating element of claim 7 wherein said transitional splices utilized consist of a slide type splice.

10. The heating element of claim 9 wherein mechanical stretching action of said resistance wire during swaging is absorbed by said slide splice.

11. The heating element of claim 7 wherein said heating element is utilized to heat solid materials.

12. The heating element of claim 7 wherein said heating element is utilized to heat metals.

13. The heating element of claim 7 wherein said heating element is utilized to heat fluids.

14. The heating element of claim 13 wherein said heating element is utilized to as the heating means in a single pass fluid heating system.

* * * * *